US007993079B2

(12) United States Patent
Depardon et al.

(10) Patent No.: US 7,993,079 B2
(45) Date of Patent: Aug. 9, 2011

(54) DEVICE AND METHOD FOR A TOWER REINFORCING FOUNDATION

(75) Inventors: François Depardon, Bourg-la-Reine (FR); Michel Deniot, Valois (FR); Bruno Mazare, Corenc (FR)

(73) Assignee: Societe Centrale d'Etudes et de Realisations Routieres Scetauroute, Guyancourt (FR)

( * ) Notice: Subject to any disclaimer, the term of this patent is extended or adjusted under 35 U.S.C. 154(b) by 479 days.

(21) Appl. No.: 11/659,821

(22) PCT Filed: Aug. 11, 2005

(86) PCT No.: PCT/FR2005/050671

§ 371 (c)(1),
(2), (4) Date: Feb. 9, 2007

(87) PCT Pub. No.: WO2006/018590

PCT Pub. Date: Feb. 23, 2006

(65) Prior Publication Data

US 2008/0056830 A1 Mar. 6, 2008

(30) Foreign Application Priority Data

Aug. 12, 2004 (FR) ..... 04 08837

(51) Int. Cl.

| | |
|---|---|
| ***E02D 27/42*** | (2006.01) |
| ***E02D 5/74*** | (2006.01) |
| ***E02D 27/50*** | (2006.01) |
| ***E02D 5/54*** | (2006.01) |

(52) U.S. Cl. ..... 405/244; 405/256; 52/170; 52/297

(58) Field of Classification Search ..... 405/243, 405/244, 229, 230–233, 239, 251, 256; 52/166, 52/169.13, 170, 292, 297, 169; *E02D 27/42*
See application file for complete search history.

(56) References Cited

U.S. PATENT DOCUMENTS 777,600 A * 12/1904 Childs ..... 52/166
(Continued)

FOREIGN PATENT DOCUMENTS

DE 100 28 755 A1 12/2001
(Continued)

OTHER PUBLICATIONS

Metelyuk: *Piles and pile foundations*, Kiev, "Budivelnik", 1977, pp. 31-32.

*Primary Examiner* — Tara Mayo-Pinnock
(74) *Attorney, Agent, or Firm* — Kenyon & Kenyon LLP

(57) ABSTRACT

A device for reinforcing a pylon foundation against being pulled out, said foundation comprising at least one block (10) which is buried in the ground of the site of the foundation and that presents a portion (12) of greatest section in a horizontal plane, the device comprising a slab (20) buried in the ground and disposed around said block (10) between said portion (12) and the surface (T) of the ground, said slab extending beyond the vertical projection of the periphery of said portion (12). The slab (20) may be made from a mixture comprising materials extracted from the site or materials brought in from elsewhere (such as a treated gravel mix) or a mixture of both, together with at least one binder. Advantageously, the total proportion of binder in said mixture lies in the range 3% to 15% by weight. The device is used to compensate for a deficit in resistance to being pulled out presented by an existing shallow foundation for a pylon.

26 Claims, 4 Drawing Sheets

U.S. PATENT DOCUMENTS

| | | | | | |
|---|---|---|---|---|---|
| 788,410 | A | * | 4/1905 | Koetitz | 405/251 |
| 918,100 | A | * | 4/1909 | Thomson | 405/230 |
| 1,101,911 | A | * | 6/1914 | Fay | 52/166 |
| 1,271,105 | A | * | 7/1918 | Wagner | 256/51 |
| 1,320,720 | A | * | 11/1919 | Tomlinson | 405/229 |
| 1,451,799 | A | * | 4/1923 | Youngblood | 405/230 |
| 1,539,033 | A | * | 5/1925 | Youngblood | 405/230 |
| 1,898,304 | A | * | 2/1933 | Kent | 264/31 |
| 2,032,030 | A | * | 2/1936 | Talen | 52/166 |
| 2,833,006 | A | * | 5/1958 | Andrews et al. | 52/169.13 |
| 3,473,279 | A | * | 10/1969 | Saiko et al. | 52/297 |
| 3,573,427 | A | * | 4/1971 | Minsk | 219/213 |
| 3,952,520 | A | * | 4/1976 | Shillingford | 405/31 |
| 4,001,990 | A | * | 1/1977 | Chase et al. | 52/167.4 |
| 4,043,133 | A | * | 8/1977 | Yegge | 405/239 |
| 4,060,994 | A | * | 12/1977 | Chitis | 405/238 |
| 4,338,047 | A | * | 7/1982 | David | 405/230 |
| 4,549,385 | A | * | 10/1985 | Cohen et al. | 52/741.11 |
| 4,659,256 | A | * | 4/1987 | Bullivant | 405/230 |
| 4,711,603 | A | * | 12/1987 | Rippe et al. | 405/230 |
| 4,875,808 | A | * | 10/1989 | Kellison | 405/244 |
| 5,243,795 | A | * | 9/1993 | Roberts | 52/158 |
| 6,665,990 | B1 | * | 12/2003 | Cody et al. | 52/295 |
| 6,913,644 | B2 | * | 7/2005 | Rizza | 106/805 |
| 7,003,919 | B2 | * | 2/2006 | Riker | 52/170 |
| 2002/0152695 | A1 | * | 10/2002 | Gilsdorf | 52/98 |
| 2005/0051208 | A1 | * | 3/2005 | Mount | 136/259 |
| 2007/0065233 | A1 | * | 3/2007 | Collina et al. | 405/232 |

FOREIGN PATENT DOCUMENTS

| | | | | |
|---|---|---|---|---|
| FR | 2 837 509 | A | | 9/2003 |
| FR | 2 845 705 | | | 4/2004 |
| JP | 60003320 | | | 1/1985 |
| JP | 04055522 | A | * | 2/1992 |
| JP | 11061854 | A | * | 3/1999 |
| JP | 2004190241 | A | * | 7/2004 |
| WO | WO 01/40585 | A | | 6/2001 |

* cited by examiner

DEVICE AND METHOD FOR A TOWER REINFORCING FOUNDATION

This is a 371 national phase application of PCT/FR2005/050671 filed 11 Aug. 2005, claiming priority to French Patent Application No. FR 0408837 filed 12 Aug. 2004, the contents of which are incorporated herein by reference.

BACKGROUND OF THE INVENTION

The present invention relates to a device and to a method for reinforcing a pylon foundation against being pulled out, and it is intended more particularly for reinforcing an existing pylon foundation of the so-called "shallow" type.

A shallow foundation is a foundation near the surface that provides the pylon with stability by spreading loads over an area of ground that is large enough. For example, lattice-type pylons generally stand on a foundation made up of four blocks, i.e. four individual blocks of concrete buried, at least in part, in the ground so as to counter toppling moments applied to the pylon in a lever-arm configuration. Changes in regulations concerning the stability of structures are requiring foundations of this type to be reinforced if they are not strong enough.

In general, reinforcement is required only against pulling-out forces. In most cases, the bearing area of shallow foundations is sufficient to withstand compression forces.

Various methods and devices for reinforcing a pylon foundation against being pulled out are already known. Those methods are implemented on existing foundations and seek to compensate for the deficit in pull-out strength of at least one block of the foundation. The term used is "force deficit" which is written Qal below and is expressed in newtons (N).

Several factors can lie behind the deficit Qal, including an increase in the pull-out force to which the foundation is subjected. Such an increase can be due:

- to changes in the operating conditions of the foundation (conditions may be climatic, mechanical, geometrical . . . );
- to weakening in the characteristics of the ground around the foundation blocks, due to an external phenomenon which may be natural or artificial (storm, earthquake, engineering works . . . ); and
- to the difference between the real shape of the foundation and its design shape, due to faulty fabrication of the foundation.

Depending on the value of the pull-out force deficit Qal that needs to be compensated, recourse is had at present to two known methods.

The first consists in casting a block of concrete around the leg of the pylon or the non-buried portion of the block (if there is one), so as to increase the weight of the foundation by adding the weight of said concrete block. Nevertheless, since it is appropriate to limit the size of the block so as to limit the space it occupies around the base of the pylon, the weight of the block is limited and can serve only to compensate small values of force deficit Qal, generally values less than 20 kilonewtons (kN).

The second known reinforcement method consists in reinforcing the foundation by means of micropiles that are mechanically connected to the legs of pylons and that are thrust deeply into the ground down to a deep substratum presenting good mechanical strength, such as a substratum of rock. That method is described in document FR 2 810 056. The micropiles take on all of the loads applied to the pylons (the existing foundation is hardly stressed any more and is useful only in terms of the weight of its own concrete that it contributes to the assembly). The lateral friction between each micropile and the deep substratum can enable high deficits Qal to be compensated, deficits greater than 1000 kN. However, the size of the micropiles, their technical nature, and the means needed for putting them in place make this second method very expensive. In practice, pylons are generally never located close to roadways and it is often necessary to use heavy equipment on agricultural or sloping ground.

BRIEF SUMMARY OF THE INVENTION

An object of the invention is to provide a method of reinforcing a pylon foundation against being pulled out, which method is inexpensive, easy to implement, and requires for its implementation means that are compact and capable of compensating pull-out force deficits Qal of "intermediate" magnitude, i.e. of the order of about 100 kN, and preferably less than 1000 kN.

To achieve this object, the invention provides a method of reinforcing a pylon foundation against being pulled out, said foundation comprising at least one block that is buried in the ground of the site on the foundation and that presents a portion of greatest area in a horizontal plane, the method being characterized in that it comprises the following steps:

- digging an excavation around said block at least above said portion;
- making a slab in the excavation so that slab is buried in the ground and disposed around said block between said portion and the surface of the ground, and so that it extends beyond the vertical projection of the periphery of said portion; and
- covering said slab.

By covering said slab, it is hidden and, where appropriate, agriculture can be carried out at the site of the foundation.

The term "slab" is used in the present specification to designate a mass of material that is compact and solid, and having a variety of shapes and thicknesses. Advantageously, in order to make said slab, a workable mixture is prepared comprising materials extracted from the ground of the site or materials brought in from elsewhere or a mixture of both, together with at least one binder, and said mixture is deposited in said excavation, the slab being the result of said mixture setting. Advantageously, the mixture is sufficiently workable to enable it to be cast into the excavation. The nature of the materials and the proportion of binder suitable for use in making such a slab are a function of the force deficit Qal to be compensated.

Advantageously, it is desired to make a slab presenting density and/or breaking shear stress that are greater than those of the ground (or terrain) of the site of the foundation.

The method of the invention makes it possible to compensate the force deficit Qal by increasing the weight of material involved when a pull-out force is applied: this is due firstly to the weight of the slab itself, and secondly, and additionally, to the weight of a surrounding mass of ground, in particular the ground on top of the slab that would be carried away by the slab being pulled out. This is made possible by the fact that the slab extends horizontally beyond the periphery of said portion, such that on being pulled out, the slab takes with it a mass of ground, referred to below as the "additional" mass, that would not have been taken away in the absence of the slab.

The force deficit Qal is also compensated by the increase in lateral friction between the reinforcing slab and the ground that remains in place.

Advantageously, in order to ensure that lateral friction plays a sufficiently large part in providing reinforcement against a pull-out force, the slab is in direct contact with the ground of the site and good lateral adhesion is provided between the slab and the ground that remains in place. Naturally, the magnitude of the lateral friction is directly associated with the intrinsic mechanical characteristics of the ground in place. Advantageously, in order to improve lateral adhesion, said slab is compacted or vibrated so that under the effect of the compacting or vibration it tends to spread sideways. The side surfaces of the slab then exert pressure against the surrounding ground, thus reinforcing lateral adhesion and hence the amplitude of lateral friction when a pull-out force is applied. In the same manner, and advantageously, the materials used for covering the slab are compacted so as to ensure good lateral adhesion between said materials and the ground that has remained in place.

Furthermore, it is also appropriate to avoid the side surfaces of the slab and the facing side surfaces of the surrounding ground being too smooth. Given the materials used and the machinery employed for digging the excavation, these surfaces generally present sufficient roughness.

The method of the invention also makes it possible to make the slab directly on the site of the foundation and to avoid any need for transporting such a slab. In addition, the on-site work required for implementing the method of the invention remains reasonable since the digging is shallow (the depth of the excavation is no greater than the depth of the top of the portion of greatest horizontal section) and of limited width (the slab generally does not extend beyond the vertical projection of said portion by more than two meters). Furthermore, the method does not require special or large equipment to be used. Finally, it is possible to reinforce only one block at a time of the foundation without it being necessary to reinforce all of the blocks.

Preferably, the slab is in direct contact with the block and surrounds it. Nevertheless, a slab surrounding the block without being directly in contact therewith, for example a slab in the form of a ring, could also be envisaged, providing it extends beyond the vertical projection of the periphery of said portion, and providing it is liable to take with it an additional mass of ground.

Furthermore, it should be observed that in order to obtain the desired reinforcement, there is no need for the slab to be mechanically connected to the block, and advantageously, in order to make the method easier to implement, the slab is not mechanically connected to the block. Naturally, when the slab is the result of a mixture being poured around the block and then hardened (setting step), the slab may adhere to the block. Nevertheless, such adhesion should not be considered as being a mechanical connection in the meaning of the invention since the strength of such a connection by adhesion is very weak compared with the force deficit Qal that is it desired to compensate. The term mechanical connection is used rather to designate fastener systems using anchoring, clamping, etc.

In order to ensure that the mixture used for making the slab is inexpensive, when the nature of the ground of the site makes this possible, at least some of the material extracted from the ground of the site when digging the excavation is used for making the slab, and preferably only the material extracted from the ground is used. In general, it is desired to use at least some of the material extracted from the ground of the site when digging the excavation for making said mixture and/or covering said slab. This saves on purchasing materials brought in from elsewhere, transporting said materials, and taking away the materials extracted by digging.

If the nature of the ground of the site does not enable said ground to be mixed with a binder in order to obtain a slab that is sufficiently uniform and compact (either because the material of the ground presents grains of size that are made too small or too great or because of the mineral nature of the ground), then materials brought in from elsewhere are used, i.e. materials that are taken to the site.

Such brought-in materials may be concretes ready for use. It is also possible to use materials that are less expensive, such as a gravel mix, i.e. natural or artificial mixtures of stones or gravel presenting grain size in the range 0 to 80 millimeters (mm) and preferably in the range 0 to 40 mm.

To ensure that the mixture used for making the slab is even less expensive, it contains a small total proportion of binder, less than 15% of the mass of the mixture. It is found that this proportion is sufficient for bonding together the particles of the materials used, and thus for obtaining the desired slab. Nevertheless, in order to ensure that the binder(s) can function properly, it is preferable to select a total proportion of binder that is greater than 3%.

The binders used may be hydraulic, hydrocarbon, or synthetic binders, for example. Examples of hydraulic binders that can be mentioned are cements, breeze cements, or lime. With cement, its proportion in the mixture advantageously lies in the range 3% to 13%, and preferably in the range 6% to 10% by weight (e.g. 8%). It should be observed that all of the percentages by weight given in the present application are given for a dry mixture (i.e. without added water), unless specified otherwise.

In addition, it is found that the mixing time needed for making the mixture is relatively short. This results in savings of time and energy.

Advantageously, when using the materials extracted on-site for making the slab and when said materials contain a large portion of clay, lime is used for neutralizing the clay. The proportion of lime in the mixture then lies in the range 1% to 4% by weight.

When the slab is made from materials brought in from elsewhere and when it presents mechanical strength and density that are sufficiently high compared with the surrounding ground, it may be desired to reduce the volume of the slab, and consequently the volume of material to be extracted from the ground of the site. This also makes it possible to use a large fraction or even all of the extracted material for covering the slab without the level of the ground over the slab becoming too high (a ground level that is too high would impede access to the pylon when putting equipment around the pylon in the event of repair being necessary, or indeed would constitute an impediment for undertaking agriculture on the ground where the pylon is standing), thereby limiting (or even eliminating) costs associated with taking the extracted material away.

The surface layer of ground that covers the slab thus contributes to reinforcing the foundation. In particular, the mass of ground covering the part of the slab that extends beyond the vertical projection of the periphery of said portion constitutes an additional mass of material (compared with the mass of ground that would be pulled out if no slab were present) that becomes involved if the foundation is pulled out.

Furthermore, this surface layer of ground can be tilled by the owner of the field in which the foundation is buried. Since pylons are commonly installed in ground that is tilled or suitable for being tilled, this advantage is not negligible. Advantageously, in order to leave a layer of ground that is sufficiently thick to be capable of being tilled and sufficiently heavy to contribute to reinforcing the foundation, the slab is buried at a depth lying in the range 0.5 meters (m) to 2 m below the surface of the surrounding ground.

The invention also provides a device for reinforcing a pylon foundation against being pulled out, the device being characterized in that it comprises a slab buried in the ground and disposed around the foundation block between the portion of greatest horizontal section of the block and the surface of the ground, said slab extending beyond the vertical projection of the periphery of said portion.

Advantageously, said slab is made from a mixture comprising materials extracted from the ground of the site or materials brought in from elsewhere or a mixture of both, together with at least one binder, and said slab is the result of said mixture setting and is in direct contact with the ground of the site.

The characteristics and advantages of the method and the device of the invention can be better understood on reading the following detailed description of various embodiments of the invention shown as non-limiting examples.

BRIEF DESCRIPTION OF THE DRAWINGS

The description refers to the accompanying figures, in which.

DETAILED DESCRIPTION OF THE INVENTION

Figure 1:
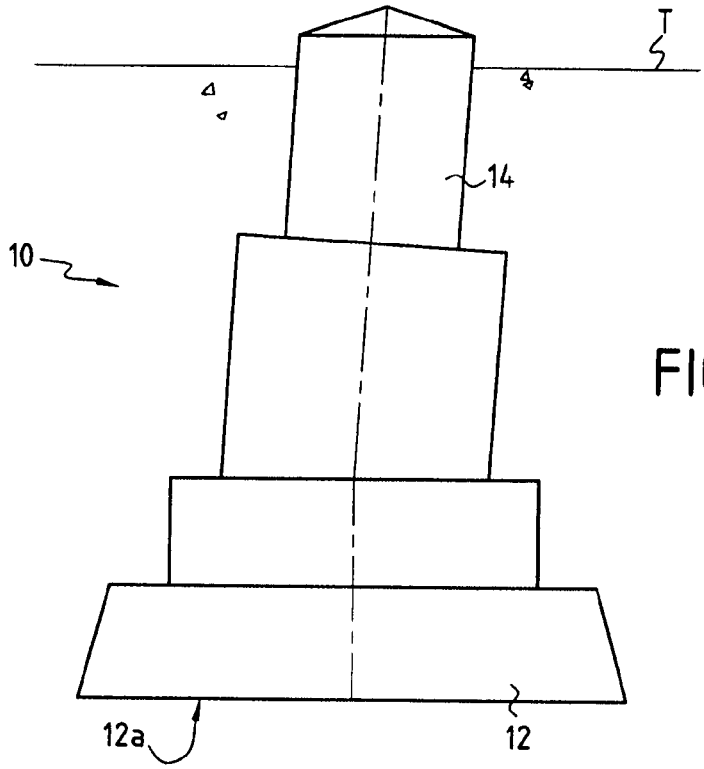
FIG. 1 shows an example of a foundation block for a pylon in elevation.
Figure 2:
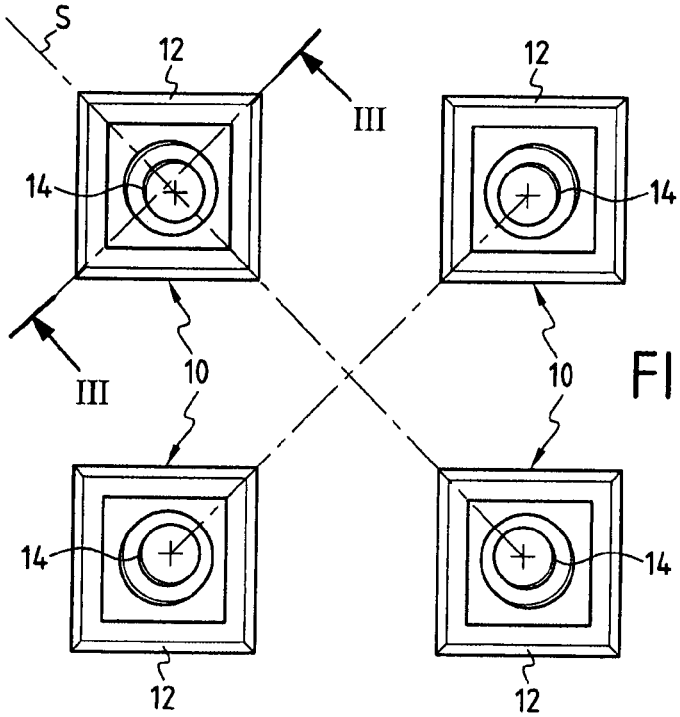
FIG. 2 is a diagrammatic plan view showing an example of a four-block foundation for a four-legged pylon.

FIG. 2 shows a pylon foundation, e.g. for an electricity pylon of the lattice type, the foundation comprising four blocks 10 of the type shown in FIG. 1 disposed in a square around the pylon (not shown). The pylon is secured to the foundation, and each block acts as a footing having a leg of the pylon anchored thereto. As can be seen in FIG. 1, blocks generally present a plurality of shoulders or steps, becoming larger going downwards, such that the bottom portion of the block, also referred to as a soleplate 12 is the portion of largest section in a horizontal plane. In the example shown, the soleplate 12 is frustoconical in shape and flares downwards. It should be observed that for other types of block, not described herein, the portion of greatest horizontal section is an intermediate portion, other than the bottom portion of the block.

In the particular circumstance of a block having no soleplate, e.g. a downwardly-flaring frustoconical block, the portion of greatest horizontal section corresponds to the bottom end portion of the block. Finally, for blocks that are rectangular or cylindrical (i.e. of constant section), the portion of greatest horizontal section is defined as being the bottom end portion of the block.

Figure 3:
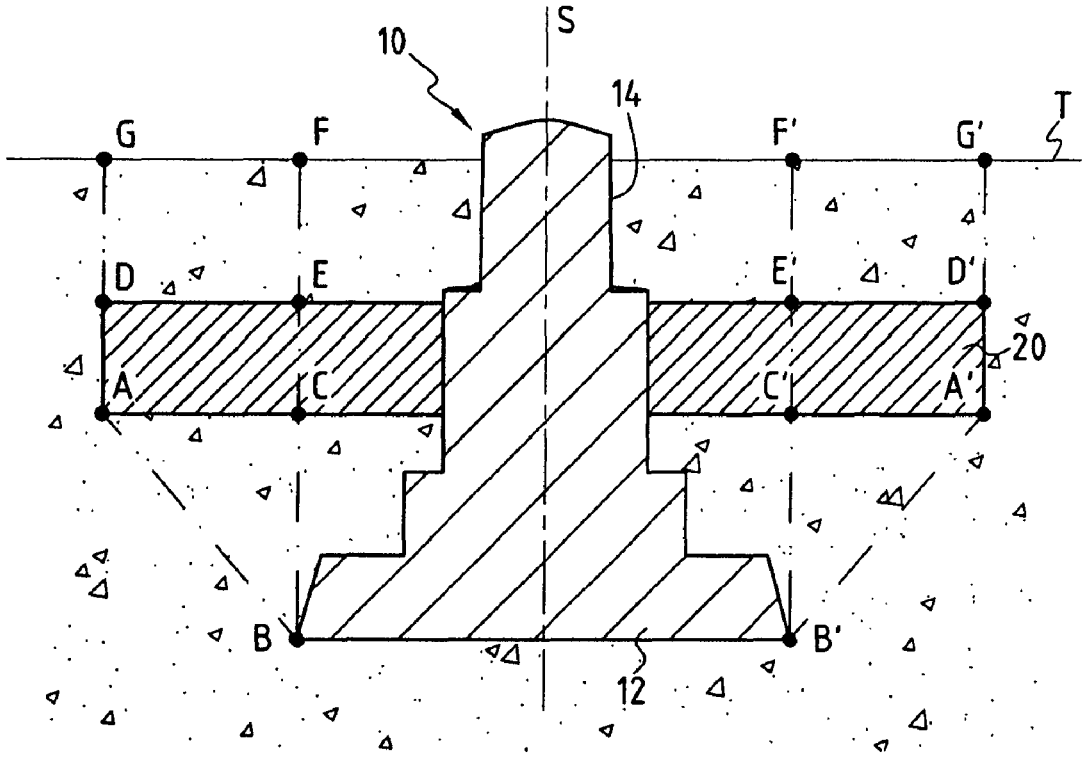
FIG. 3 shows a first embodiment of the device of the invention in section on plane III-III of FIG. 2.

FIG. 3 is a vertical section on plane III-III (i.e. perpendicular to the ground surface T, which is to be horizontal), perpendicular to the plane of symmetry S of the block and containing the center of the soleplate 12 of the block 10.

With reference to this figure, there follows a description of a first embodiment of the reinforcing device of the invention. The device comprises a slab 20 disposed above the soleplate 12 of a block 10 analogous to that described above. The periphery of the portion of the block 10 having the greatest horizontal section, i.e. in this example the periphery of the soleplate 12, is identified in section by the points B and B' (symmetrical about the plane S). The vertical projections of the point B (B') on the bottom and top faces of the slab are respectively identified as points C and E (C' and E').

The slab 20 is cylindrical in shape, however it could be frustoconical or it could present at least one shoulder on its sides so as to increase friction between its sides and the surrounding ground. The outer periphery of the slab intersects the section plane of FIG. 3 at points D and D' for its top face and at points A and A' for its bottom face. Since the slab 20 extends beyond the vertical projection of the periphery of the soleplate 12, the points A, A', D, and D' are situated outside the points C, C', E, and E' relative to the plane S. Since the slab 20 is buried in the ground, it is covered with a layer of earth referred to as a surface layer. Thus, the top face of the slab 20 (and the points D, E, E' and D') lies below the surface T of the ground. Points situated on the surface T of the ground vertically above the points D, E, E' and D' are referenced G, F, F' and G'.

In the example, the slab 20 does not rest on the second shoulder 13 of the block 10 since the ground situated between the slab 20 and the shoulder 13 is dense enough to avoid being compacted while the block is being subjected to pulling out forces, such that the slab 20 is immediately stressed on the block being raised. Nevertheless, when the density of the ground between the slab 20 and the shoulder of the block 10 situated immediately beneath the slab is too small, then the slab 20 is caused to rest on said shoulder.

In the first embodiment shown in FIG. 1, the slab 20 is made from a mixture comprising material extracted from the site (either while digging the excavation, or earlier if other earth-moving operations have been performed on the same site) and a mixture of two binders: lime and cement. Treating these materials with these binders serves to produce a slab 20 in the form of a block that is solid and compact.

Firstly, the slab 20 as obtained in this way presents density that is greater than that of the surrounding ground and thus the weight of the slab serves to increase the weight of material situated above the soleplate 12 and to improve the resistance of the foundation to being pulled out. Secondly, the slab 20 presents breaking shear stress that is greater than that of the surrounding ground so that in a pulling-out situation the vertical shear generated acts between the slab 20 and the surrounding ground, i.e. at the side surface of the slab corresponding to lines AD and A'D' in FIG. 3. To make the present description simpler to read, this type of side surface is referred to below as an AA'D'D surface.

Since the slab 20 extends beyond the periphery of the soleplate 12 in vertical projection, it is all of the materials situated above the slab within the cylinder GDD'G' and the materials within the truncated cone ABB'A' that are involved and not only the materials situated vertically above the soleplate 12 as defined by the cylinder FBB'F', as would be the case if there were no slab. Thus, compared with a pylon having no slab 20, an additional mass of ground is involved and its weight opposes pulling-out, this mass of ground being situated above the slab 20 and outside the periphery of the soleplate in vertical projection. In the figure, this additional mass of ground is in the form of a ring of material situated between the surfaces FEE'F' and GDD'G'. Similarly, an additional mass of ground is involved between the surfaces ABB'A' and CBB'C'. The additional mass of material involved is thus a function of the distance DE (or CA) by which the slab 20 extends beyond the soleplate 12 and the depth DG (or FE) at which the slab is to be found.

The above explanations illustrate in simplified manner the general principle on which the device of the invention is based. This general principle can be summarized as increasing the mass of material that will be involved in the event of a pulling-out force, firstly by acting on the weight of the slab that is made, and secondly by involving a so-called "additional" mass of ground that would not have been involved in the absence of the slab.

To be complete, account must also be taken of the friction forces involved such as the side friction forces that act between the slab and the surrounding ground when a pulling-out force is applied. It should be observed that this friction assists in reinforcing the foundation. The force deficit Qal is thus compensated mainly by the weight of the additional mass involved and by the side fraction forces.

Figure 4:
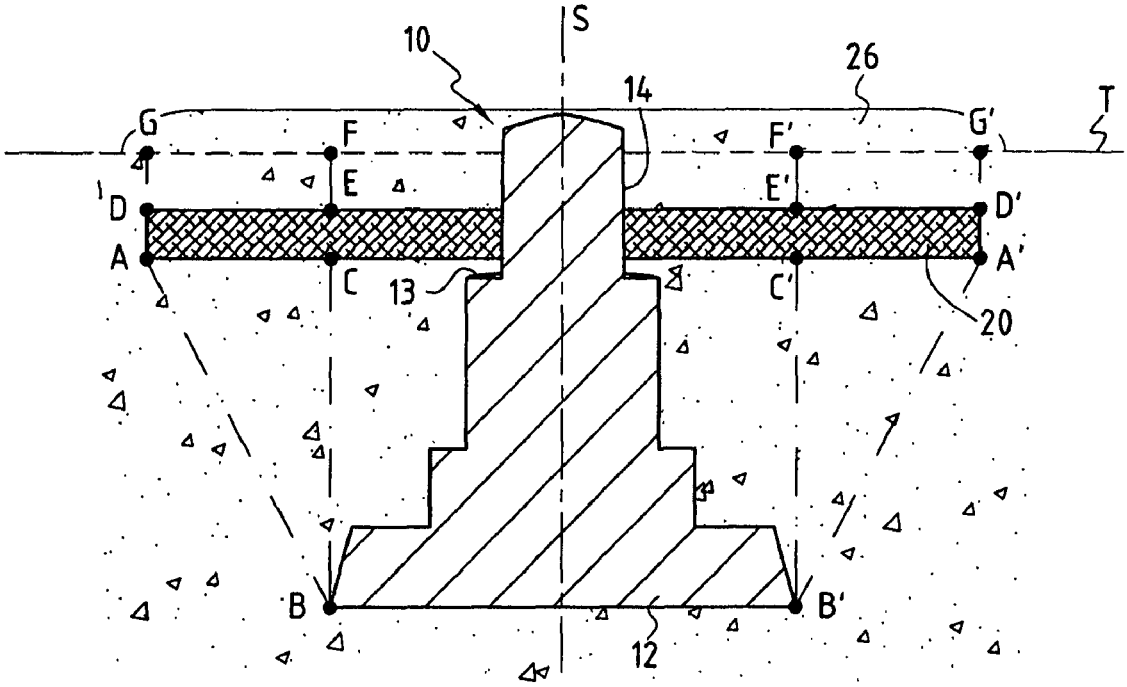
FIG. 4 shows a second embodiment of the device of the invention.

FIG. 4 shows another embodiment of the device of the invention, analogous to that of FIG. 3, but that differs therefrom by the nature of the material constituting the slab 20. This time, the slab 20 is made of a treated gravel mix, i.e. a mixture of gravel mix and binder, and preferably from a gravel mix treated with hydraulic binders. A definition of this type of treated gravel mix, together with examples, can be found in French standard NF P 98-116 dated February 2000. The gravel mix is usually mixed with binder off-site, in a mixing station, but sometimes it is done directly on-site using a mobile site mixer, e.g. a pulvimixer or a screen-bucket. Treated gravel mix is a relatively inexpensive material and can present high density and good mechanical properties, in particular good shear strength. Thus, the thickness of the slab can be quite limited, and in the example shown, the material extracted while digging the excavation can then be taken away or used for covering the slab, without the mound 26 formed over the block being an impediment because of its height which remains relatively small (preferably less than 50 centimeters (cm)).

In another embodiment of the device of the invention (not shown), in order to limit the thickness of the slab and/or in order to reinforce its mechanical properties, in particular its shear strength, it is possible to insert a reinforcing structure in the volume of the slab, such as a metal or plastic-coated grid, fabric, a geogrid, sheets of geosynthetic material, or indeed genuine metal reinforcement with the workable mixture being put into place thereabout.

It is also possible to envisage inserting sensors in the slab, e.g. housed in a geosynthetic sheet, for the purpose of measuring stress, movement, deformation . . . , such sensors making it possible remotely to monitor the behavior of the foundation in a sensitive place.

Figure 5:
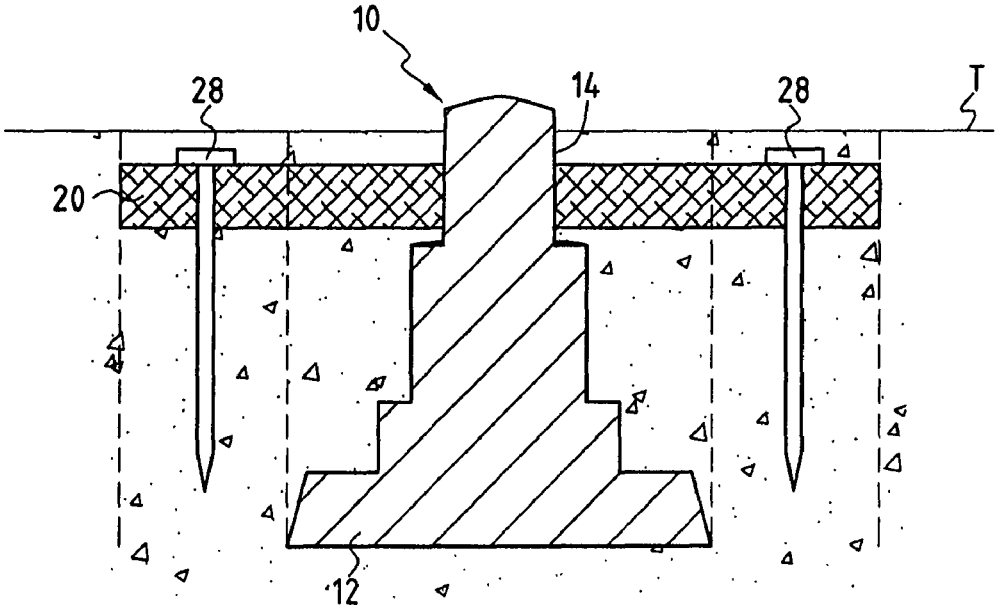
FIG. 5 shows a third embodiment of the device of the invention.
Figure 6:
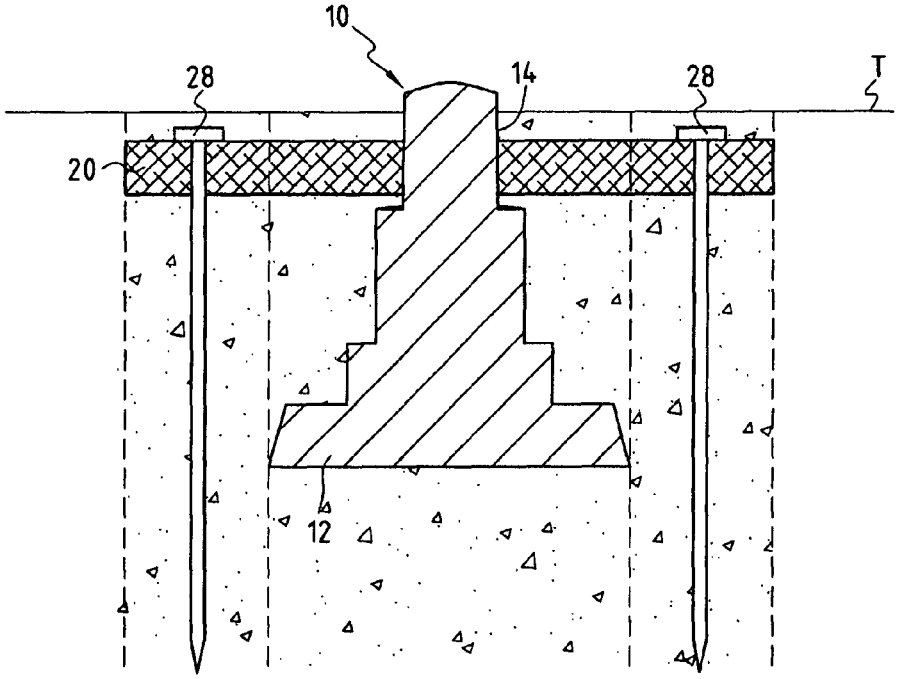
FIG. 6 shows a fourth embodiment of the device of the invention.
Figure 7:
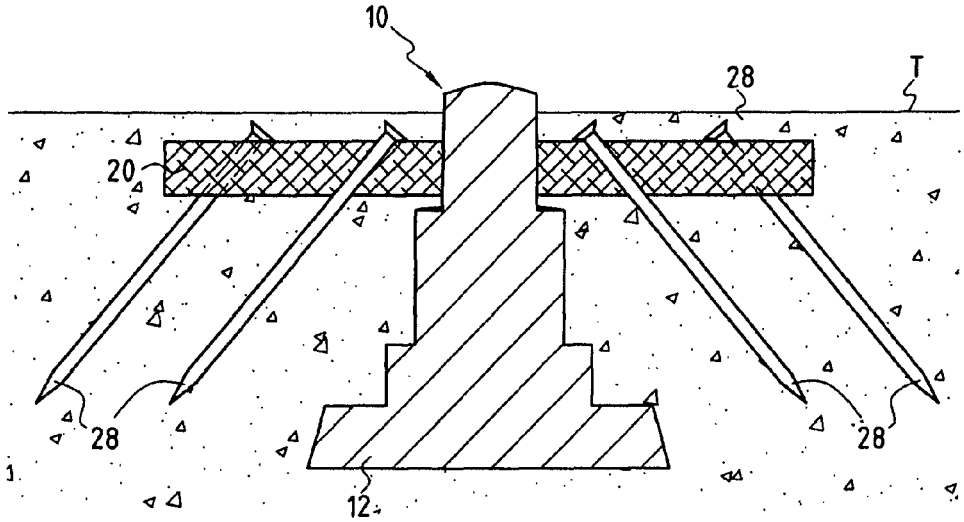
FIG. 7 shows a fifth embodiment of the device of the invention.

FIGS. 5, 6, and 7 show three other embodiments of the reinforcing device of the invention in which the slab 20 is a slab of treated gravel mix. However this slab could be of a composition analogous to that of the slab in FIG. 3, or indeed it could be the result of mixing materials extracted on-site, gravel mix, and at least one binder. The slab 20 is anchored in the ground with the help of nails 28 passing through it in the thickness direction. These nails go through the outside edge of the slab 20, preferably the portion of the slab that extends beyond the vertical projection of the periphery of the soleplate 12 of the block 10, and they extend vertically as shown in FIG. 5, or they are inclined as shown in FIG. 7. These nails 28 may be of various lengths, and as shown in FIG. 6 the nails 28 may extend below the block 10.

Nevertheless, it should be observed that in order to limit the cost of the device, the length of the nails 28 should be limited. In particular, unlike known micropiles, as mentioned above, the nails 28 of the invention do not need to extend as far as a deep substratum. Furthermore, they do not need to be mechanically connected to the leg of the pylon.

The nails 28 perform two functions: firstly they serve to anchor the slab 20, where anchoring is stronger with nails that are longer, and subsequently they serve to engage by friction with the volume of ground that surrounds them (root effect), thereby involving an even greater mass of additional ground to oppose the block 10 being pulled out.

These nails 28 may be made in the form of metal bars or tubes and a cement slip may optionally be injected therein.

The dimensions of the above-described reinforcing devices naturally depend on the dimensions of the foundation blocks to be reinforced, on the pull-out force deficit Qal to be compensated, and on the characteristics of the ground in which the devices are implanted.

As an indication, it can be considered that the soleplate 12 of foundation blocks 10 for lattice-type pylons generally presents a width and a length lying in the range 2 m to 4 m, while their depth lies in the range 2.5 m to 5 m. With the blocks shown in FIGS. 1 and 2, as used for example by the French utility R.T.E. for electricity pylon foundations, the outside diameter of the bottom portion of the block is a square having a side of 2.35 m, while the cylindrical top portion of the block presents a diameter of 90 cm. The distance between the bearing surface 12*a* of the soleplate 12 and the top end of the portion 14 is equal to 3.45 m and the block 10 is generally not completely buried but projects above the surface T of the ground by a height of 30 cm. Under such circumstances, it is generally appropriate for the slab 20 to project beyond the outer periphery of the soleplate 12 in vertical projection by a distance lying in the range 0.5 m to 1.5 m, and preferably equal to 1 m. Furthermore, when the slab 20 is buried, the top of the slab is generally situated at a depth lying in the range 0.5 m to 2 m from the surface T of the ground, preferably in the range 0.5 m to 1 m, and for example at a depth of 0.8 m, such that the ground is thick enough to be tilled. The thickness of the slab varies and depends on the material used, on the optional presence of a reinforcing structure, and on the pull-out forces to be opposed.

It should be observed that the top of the slab may be made to be sloping in order to facilitate the flow of water.

With the structure of the reinforcing device of the invention described above, there follows a description of an example of a method for installing a device as shown in FIG. 3. Initially, the zone concerned, situated vertically over each foundation block 10 that needs to be reinforced is cleared. Then, the earth is worked around the block 10 so as to obtain an excavation having a depth of about 1.8 m projecting laterally by one meter beyond the outer periphery of the soleplate 12 of the block 10. The first eighty centimeters of the ground in this zone are stripped, piled up, and kept on-site so as to be replaced subsequently.

A portion of the material extracted from the ground is then mixed with 6% to 10% and preferably 8% cement and 1% to 4% lime. Once the mixture is obtained, this mixture is placed inside the excavation in successive layers of about 30 cm that are wetted and compacted, possibly placing a reinforcing structure such as a geogrid between two successive layers. Finally, the slab as formed in this way is covered over by replacing the stripped top centimeters of the ground.

Advantageously, the stripped top centimeters of the ground are put back into place in successive layers, e.g. in layers having a thickness of 20 cm, which layers are then compacted, with compacting performed in successive layers obtaining a better result. These compacting steps enable the initial configuration to be restored (in particular density) for the layer of ground situated about the slab, thereby increasing ability to withstanding pull-out forces.

This method, which is simple and inexpensive to implement, presents the advantage of using machinery that is commonly used in the field of building and public works, such as a small digger, lightweight compacting equipment, and a movable on-site mixer.

What is claimed is:

1. A device for reinforcing an existing pylon foundation against being pulled out, said foundation comprising at least one block which acts as a footing having a leg of the pylon anchored thereto and which is buried in the ground of the site of the foundation and that presents a block portion of greatest section in a horizontal plane, said device comprising a slab entirely buried in the ground and disposed around said block and located between said block portion and the surface of the ground, said slab extending beyond the vertical projection of the periphery of said block portion.

2. A device according to claim 1, wherein said slab is not mechanically connected to said block.

3. A device according to claim 1, wherein said slab is made from a mixture comprising materials and at least one binder.

4. A device according to claim 3, wherein said slab is the result of said mixture setting and is in direct contact with the ground of the site.

5. A device according to claim 3, wherein the total proportion of binder in said mixture lies in the range 3% to 15% by weight.

6. A device according to claim 3, wherein said materials are brought in from elsewhere and are gravel treated with hydraulic binders.

7. A device according to claim 3, wherein said materials are extracted from the ground of the site.

8. A device according to claim 3, wherein said materials are brought in from somewhere else than the site.

9. A device according to claim 3, wherein said materials are a mixture of materials extracted from the ground of the site and of materials brought in from somewhere else than the site.

10. A device according to claim 1, wherein said slab presents density greater than that of the ground of the site of the foundation.

11. A device according to claim 1, wherein said slab presents breaking shear stress greater than that of the ground of the site of the foundation.

12. A device according to claim 1, wherein said slab is buried in the ground at a depth lying in the range 0.5 m to 2 m, below the surface of the ground.

13. A device according to claim 1, wherein said slab is anchored in the ground by means of nails passing through the slab in its thickness direction.

14. A device according to claim 1, wherein said slab presents a reinforcing structure.

15. A method of reinforcing an existing pylon foundation against being pulled out, said foundation comprising at least one block that acts as a footing having a leg of the pylon anchored thereto, that is buried in the ground of the site of the foundation and that presents a block portion of greatest section in a horizontal plane, the method comprising the following steps:

digging an excavation around said block at least above said block portion;

making a slab in the excavation so that said slab is entirely buried in the ground and disposed around said block and located between said block portion and the surface of the ground, and so that it extends beyond the vertical projection of the periphery of said block portion; and covering said slab.

16. A method according to claim 15, wherein, in order to make said slab, a workable mixture is prepared comprising materials and at least one binder, and said mixture is deposited in said excavation, the slab being the result of said mixture setting.

17. A method according to claim 16, wherein the total proportion of binder in said mixture lies in the range 3% to 15% by weight.

18. A method according to claim 16, wherein said materials are extracted from the ground of the site.

19. A method according to claim 16, wherein said materials are brought in from somewhere else than the site.

20. A method according to claim 16, wherein said materials are a mixture of materials extracted from the ground of the site and of materials brought in from somewhere else than the site.

21. A method according to claim 15, wherein at least a part of the material extracted from the ground of the site when digging the excavation is used to cover said slab.

22. A method according to claim 15, wherein said mixture is deposited in successive layers, a reinforcing structure being deposited between at least two of said layers.

23. A method according to claim 15, wherein the mixture used for making said slab and/or the materials used for covering said slab are subjected to compacting or vibration.

24. A method according to claim 15, wherein said slab is buried in the ground at a depth lying in the range 0.5 m to 2 m, below the surface of the ground.

25. An assembly comprising a pylon secured to a foundation that includes at least one block that acts as a footing having a leg of the pylon anchored thereto, that is buried in the ground of the site of the foundation and that presents a block portion of greatest section in a horizontal plane, together with a device for providing reinforcement against being pulled out, said device comprising a slab entirely buried in the ground and disposed around said block and located between said block portion and the surface of the ground, said slab extending beyond the vertical projection of the periphery of said block portion.

26. An assembly according to claim 25, wherein said slab is buried in the ground at a depth lying in the range 0.5 m to 2 m, below the surface of the ground.

* * * * *